US006746137B1

(12) United States Patent
Yeh

(10) Patent No.: US 6,746,137 B1
(45) Date of Patent: Jun. 8, 2004

(54) ENHANCED LAMPSHADE FOR KNOCKDOWN SHIPPING AND PROCESS FOR USING SAME

(76) Inventor: John Yeh, 800 A Iowa Ave., Riverside, CA (US) 92507

( * ) Notice: Subject to any disclaimer, the term of this patent is extended or adjusted under 35 U.S.C. 154(b) by 0 days.

(21) Appl. No.: 10/330,365

(22) Filed: Dec. 27, 2002

(51) Int. Cl.[7] ..... F21V 1/06; F21V 11/00

(52) U.S. Cl. ..... 362/352; 362/358; 362/360; 362/361; 362/357; 362/367; 362/368; 362/440; 362/450; 362/806; 362/311

(58) Field of Search ..... 362/352, 351, 362/358, 360, 361, 356, 357, 367, 368, 440, 450, 806, 277, 282, 283, 311, 355

(56) References Cited

U.S. PATENT DOCUMENTS 1,867,562 A * 7/1932 Burke ..... 362/352
3,162,377 A 12/1964 Ozeki
6,439,746 B2 8/2002 Huang

* cited by examiner

*Primary Examiner*—Stephen Husar
*Assistant Examiner*—Sharon Payne
(74) *Attorney, Agent, or Firm*—Intellepharm, Inc.; Manfred E. Wolff

(57) ABSTRACT

A lampshade adapted to be interconvertible between an assembled configuration having a first volume and a knockdown configuration having a second, smaller volume comprises lampshade segments connected to rotational elements. Slotting means on preselected rotational elements position the connecting members to assume predetermined positions with respect to the common axis, where the rotational elements are locked in place. Methods for use of the lampshade in knockdown shipping, and kits containing the lampshade and instructional materials are also taught.

19 Claims, 5 Drawing Sheets

ENHANCED LAMPSHADE FOR KNOCKDOWN SHIPPING AND PROCESS FOR USING SAME

BACKGROUND ART

A common problem in the home furnishings business is that many articles occupy a large volume of space, although much of that space is empty. For example a table having a top and four legs occupies a cube-like expanse of space, although much of the volume under the tabletop is empty. This characteristic causes problems in shipping and transporting home furnishings, because such home furnishings require large shipping containers and occupy large volumes of space in transporting vehicles, resulting in high shipping costs. Moreover, home furnishings in one or more oversize shipping containers are difficult objects for a customer to transport in the luggage compartment or passenger compartment of a standard passenger automobile. This problem obviously becomes even more acute in the case of items that incorporate several components having large dimensions or volumes. For example, floor lamps have lengthy lampposts and bulky lampshades. It is a common practice nowadays for customers to take purchases home in their own passenger automobiles, rather than to incur the added expense of obtaining home delivery by a delivery van. Thus, lost sales may result from the reluctance of customers to purchase articles contained in one or more oversize shipping containers.

A solution to this problem has been the practice of shipping home furnishings in a "knock-down" or "KD" state, in which the home furnishings are shipped partially unassembled to conserve space both in the shipping container and the transporting vehicle. For example, the table cited above could be shipped as a knocked-down shipment comprising a top and four separated legs, for later assembly. Under these circumstances, it is further required that the assembly procedure result in a robustly reassembled article that will not loosen and disassemble under normal use, and that the assembly procedure be a simple one, since it is normally carried out by the customer. It is important to emphasize that a "knockdown state" is in no way the same as an "unassembled state" which may involve a collection of a multitude of parts. Preferably, a "knockdown state" comprises a few parts that can be simply and rapidly reassembled without the need for elaborate tools or special skills. Moreover, it is important that the final, reassembled product be aesthetically pleasing, and in particular, that it should not display any visual evidence of the knockdown enabling features. Particularly in the case of lampshades, which are valued for their aesthetically pleasing features, disassembly and reassembly should not result in either aesthetically displeasing visual evidence or in damage resulting from the reassembly efforts of an ordinary customer without specialized training. Thus, a successful knockdown article is one that can be easily and safely reassembled by the customer from a few parts to form a robust unit without any aesthetically displeasing visual evidence or damage resulting from either the reassembly measures or the reassembly efforts of an ordinary customer without specialized training, and one that at the same time results in a significant saving of shipping space.

Lampshades are devices that partially block the radiation of light from illumination means. Illumination means are defined as any structure that includes a source of light, including table lamps, wall lamps, lanterns, candlesticks and their holders, street lamps, etc. Lampshades can be fixedly or removably attached to any part of the illumination means—for example to the lamp structure or to a light bulb—or they may be fixedly or removably attached to a nearby structure—for example, the wall to which a wall lamp is attached. Many types and configurations of lampshades are known in the lampshade art. For example, they may have a hollow generally conical, cylindrical, or cube-like configuration having an open top and bottom. However, the structures of lampshades often have features that restrict their economical shipment. Such lampshades are undesirably expensive to ship due to their relatively large diameter and height, which result in a lampshade that has a large volume. Shipping containers for fully assembled lampshades require excessive shipping room and thus transportation by ship or truck becomes relatively costly as a high volume of unused space is created. Accordingly, the shipper is paying for the excess unused space. Moreover, a lampshade in an oversize shipping container is a difficult object for a customer to transport in a standard passenger automobile. It is a common practice nowadays for customers to take purchases home in their own passenger automobiles, rather than to incur the added expense of obtaining home delivery by a delivery van.

This invention relates to novel, useful lampshades adapted for shipping in a knockdown state, and more particularly, to lampshades comprising at least two segments interconnected by a rotational locking connector means. Even more particularly, the present invention comprises novel lampshade structures, wherein the lampshade is separated into at least two segments interconnected by a rotational locking connector means and wherein the segments are adapted to be securely and aesthetically reunited with the use of clips. Such clips may include decorative features. This knockdown construction allows a shipping container to be constructed in dimensions that are only a fraction of what would otherwise be required but for the present invention. For example, a conical lampshade having a maximum diameter of about 16.5 inches (42 cm.) and a height of 10 inches (25 cm.) would require a container of at least 16.5×16.5×10 inches having a volume of about 2723 cu. in. (44,100 cc.). By contrast, the same lampshade, when manufactured as three segments using the KD lampshade and method of this invention, could be shipped in a container of about 9×14×10 inches having volume of only about 1260 cu. in. (20,406 cc.). The lampshade sections are disassembled without disconnection when shipped and are then reassembled after reaching their destination or later after sale to the purchaser. The present invention provides a KD lampshade that enables a purchaser to take the lampshade at the time of purchase for transportation in a passenger automobile. The present invention further provides a KD lampshade that is easily assembled without the use of tools by a person of average dexterity.

Applicant believes he is familiar with commercially available lampshades for knockdown shipping, and he represents that he never has encountered a lampshade constructed in accordance with this invention. By way of background, attention is called to the lampshade disclosed in U.S. Pat. No. 6,439,746 by C.-F. Huang. This lampshade is not an advantageous knockdown structure because the lampshade is disassembled into a multiplicity of disconnected parts in its knockdown configuration. As has already been discussed, an advantageous knockdown structure must be configured in a manner where the conversion to the final article is rapid, facile, and structurally sound, when practiced by even an inexperienced consumer. An example of an effort to avoid these limitations is the disclosure Hidetaro Ozeki in U.S. Pat. No. 3,162,377 describing a collapsible lantern structure. However, this is a paper lantern and its construction is not applicable to a typical lampshade structure.

In contradistinction to these lampshades, the present invention embraces and finally addresses the clear need for a novel, useful lampshade for knockdown shipping, and more particularly to a successful knockdown lampshade that can be easily and safely reassembled by the customer from a few parts to form a robust unit without any aesthetically displeasing visual evidence or damage resulting from either the reassembly measures or the reassembly efforts of an ordinary customer without specialized training, and one that at the same time results in a significant saving of shipping space. Thus, as pioneers and innovators attempt to make KD lampshades cheaper, more universally used, and of higher quality, none has approached same in combination with simplicity and reliability of operation, until the teachings of the present invention. It is respectfully submitted that other references merely define the state of the art or show the type of systems that have been used to alternately address those issues ameliorated by the teachings of the present invention. Accordingly, further discussions of these references has been omitted at this time due to the fact that they are readily distinguishable from the instant teachings to one of skill in the art.

OBJECTS AND SUMMARY OF THE INVENTION

In light of the foregoing, it is therefore a general object of the invention to provide a novel, useful KD lampshade intended to obviate or minimize the problems of the type previously noted. It is a particular object of the invention to provide KD lampshades wherein the segments may be locked against rotational movement relative to one another by means of a simple and unexposed locking assembly. It is an important object of the present invention to provide a KD lampshade structure that can be be packaged in its knock-down configuration in a standard shipping container of advantageously reduced size. It is a further important object of the present invention to provide a KD lampshade structure that can be converted to its KD configuration without disconnection of its segments. It is another object of the present invention to make possible a KD lampshade packaged to enable a purchaser to take the lampshade at the time of purchase. It is a further object of the present invention to provide a lampshade of knockdown character whereby the lampshade is easily assembled without the use of tools by a person of average dexterity. A still further object of the present invention is to provide a lampshade of knockdown character that is simple in its structure and rugged in construction, as well as relatively inexpensive to manufacture, and yet pleasing in its design. It is yet still a further object of the invention to provide a KD lampshade of which, when the connector fittings and the segments are in their assembled state, is always fitted snugly together even when made with only modestly stringent manufacturing tolerances. It is even still a further object of the invention to provide a knock-down lampshade wherein the relative rotation of the initially loosely fitting telescoping KD parts into a locking position automatically draws the lampshade segments involved snugly against each other, so that no unsightly gaps are visible between them. It is yet another object of the invention to provide a knock-down lampshade as described wherein the parts thereof, even after repeated assembly and disassembly thereof, continue to form a secure, tightly fitting joint. It is even another object of the invention to provide a lampshade that includes a rotational connector that can exist in two general configurations, viz a telescopically extended configuration adapted for lampshade KD, in which rotational elements of the connector are free to rotate and are not positioned within one another, and an assembled, telescopically compact configuration adapted for functional lampshade use, in which rotational elements of the connector are not free to rotate and are positioned within one another.

These and other objects are accomplished by the parts, constructions, arrangements, combinations and subcombinations comprising the present invention, the nature of which is set forth in the following general statement, and preferred embodiments of which—illustrative of the best modes in which applicant has contemplated applying the principles—are set forth in the following description and illustrated in the accompanying drawings, and are particularly and distinctly pointed out and set forth in the appended claims forming a part hereof.

The present invention is directed to a lampshade adapted to be interconvertible between an assembled configuration having a first volume and a knock-down configuration having a second, smaller volume. The lampshade may be generally conical, generally cylindrical, generally hemispherical, or may have generally rectangular segments. The lampshade may comprise at least two lampshade segments, a predetermined number of connecting members, and a predetermined number of rotational elements having a common axis of rotation adapted to be positioned within one another. The connecting members connect preselected rotational elements with preselected lampshade segments. Assembly means, which may comprise spring means, permit rotational movement of the rotational elements and maintain them in a substantially inseparable assembly. The spring means may be disposed on the common axis to urge the rotational elements and locking means apart. The spring means may be further adapted to permit rotational movement of the locking means and the rotational elements; and even further adapted to maintain the rotational elements and the locking means in a substantially inseparable assembly. Slotting means on preselected rotational elements are adapted to slottingly fit connecting members. The slotting means are further adapted to position the connecting members to assume predetermined angular positions with respect to the common axis. Locking means are adapted for lockingly positioning the connecting members in predetermined angular positions. The lampshade may further comprise mounting means for mounting on a lamp. The connecting members may be attached to preselected rotational elements and preselected lampshade segments by attachment means such as welding, soldering, gluing, press fitting, tying, wiring, bolting, crimping, and manufacture as a single unit. Clipping means adapted for clipping together preselected borders of the lampshade segments may be included in the lampshade.

A method for knock-down shipping and subsequent reassembly of a lampshade adapted to be interconvertible between an assembled configuration having a first volume and a knock-down configuration having a second, smaller volume comprises providing the lampshade in the assembled configuration having a first volume, unclipping the clip means if there are any, unlocking the locking means, urging the rotational elements and the locking means apart on said common axis of rotation, positioning the segments into the knock-down configuration, and packaging the lampshade in the knock-down configuration in a package. Then transporting the package as a shipment, unpacking the shipment, rotating the segments into the assembled configuration, urging the rotational elements and the locking means together on the common axis of rotation, locking the locking means, and clipping the segment clips, if there are any.

A kit for shipping a lampshade structure lampshade adapted for shipping in a knock-down state comprises the lampshade, packaging materials and at least one device selected from the group consisting of printed materials, CD disks, magnetic data storage disks, and videotapes for explaining the assembly of the lampshade.

In sum, the above and other objects, features and objectives of the present invention, shall become apparent with the following description whether in conjunction with the accompanying drawings, in which like reference numerical designating indicators designate the same elements.

Definitions

Unless defined otherwise, all technical and scientific terms used herein have the same meaning as is commonly understood by one of skill in the art to which this invention belongs. All patents and publications referred to herein are incorporated by reference.

As used herein, a "lampshade" is any device that can partially block the radiation of light from an illumination means.

As used herein, an "illumination means" is any source of artificial light, including light bulbs, table lamps, wall lamps, lanterns, desk lamps, candlesticks and their holders, street lamps, etc.

As used herein, a lampshade can be fixedly or removably attached to any part of an illumination means, or alternatively fixedly or removably attached to a structure adjacent to an illumination means—for example, a wall to which a wall lamp is attached.

As used herein, the term "fixedly secured" means attached by such known processes as, for example, welding, soldering, gluing, press fitting, bolting, screwing, nailing, tying, wiring, crimping, manufacturing as a single unit, etc.

As used herein, the term "adapted for connecting" includes connecting by such known processes as, for example, welding, soldering, gluing, press fitting, bolting, screwing, nailing, tying, wiring, crimping, manufacturing as a single unit, etc.

As used herein, the terms relating to telescopes such as "telescopically compact" and "telescopically extended" refer to the structural configurations exhibited by telescopes constructed of a series of tubes, wherein a compact form can be produced by urging the tubes to lie within one another, and an extended form can be produced by reversing the process. As used herein, adverbs, adjectives and verbs such as telescopically and telescope refer to the configurational characteristics of telescopes, as just defined, and not to the optical characteristics of telescopes.

DETAILED DESCRIPTION OF THE PREFERRED EMBODIMENTS

Figure 1:
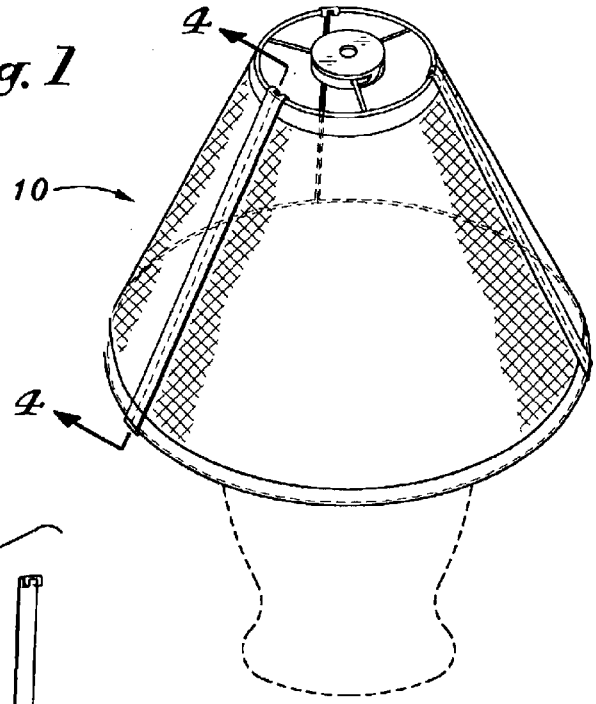
FIG. 1 is a perspective view of a generally conical KD lampshade in its assembled state, comprising three lampshade segments connected to rotational connector that is lockingly fitted together in a telescopically compact configuration, the edges of said lampshade being fastened together by three segment clips, in accordance with an embodiment of the present invention.
Figure 2:
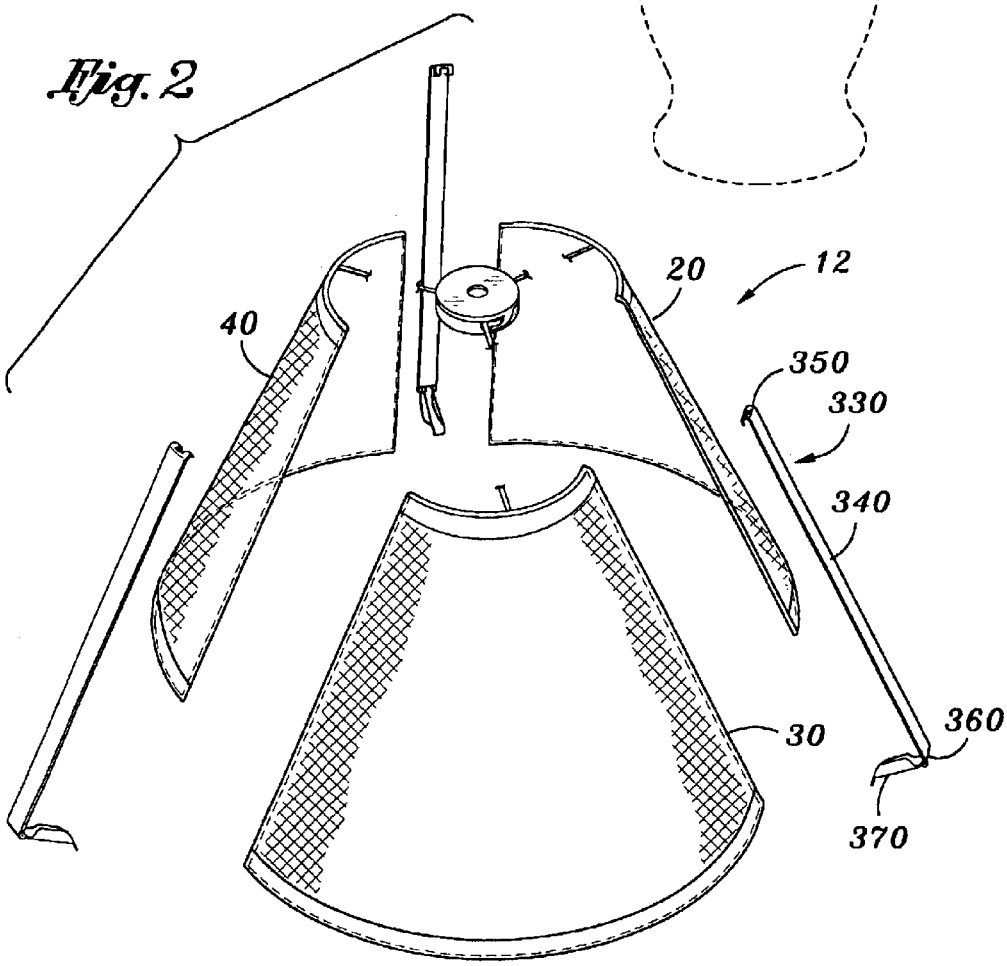
FIG. 2 is an enlarged exploded perspective view of the lampshade in FIG. 1.
Figure 3:
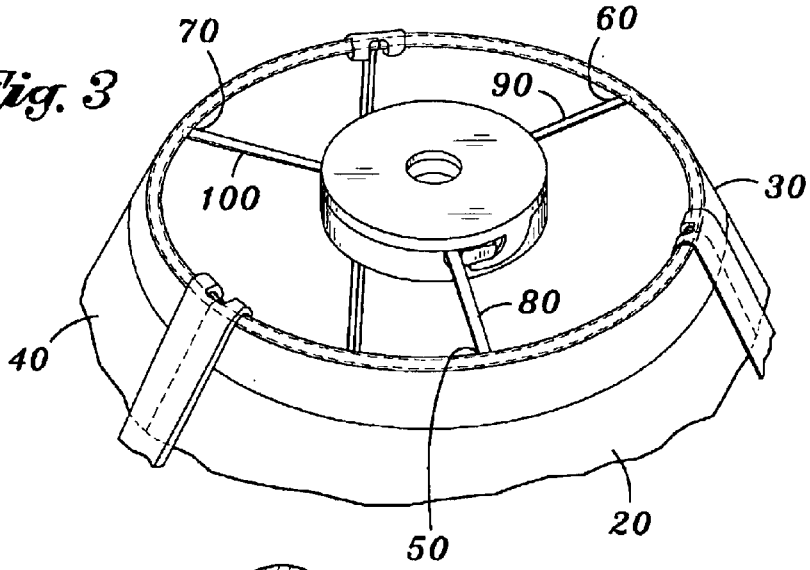
FIG. 3 is an enlarged perspective view in partial section of the top of the lampshade in FIG. 1.
Figure 4:
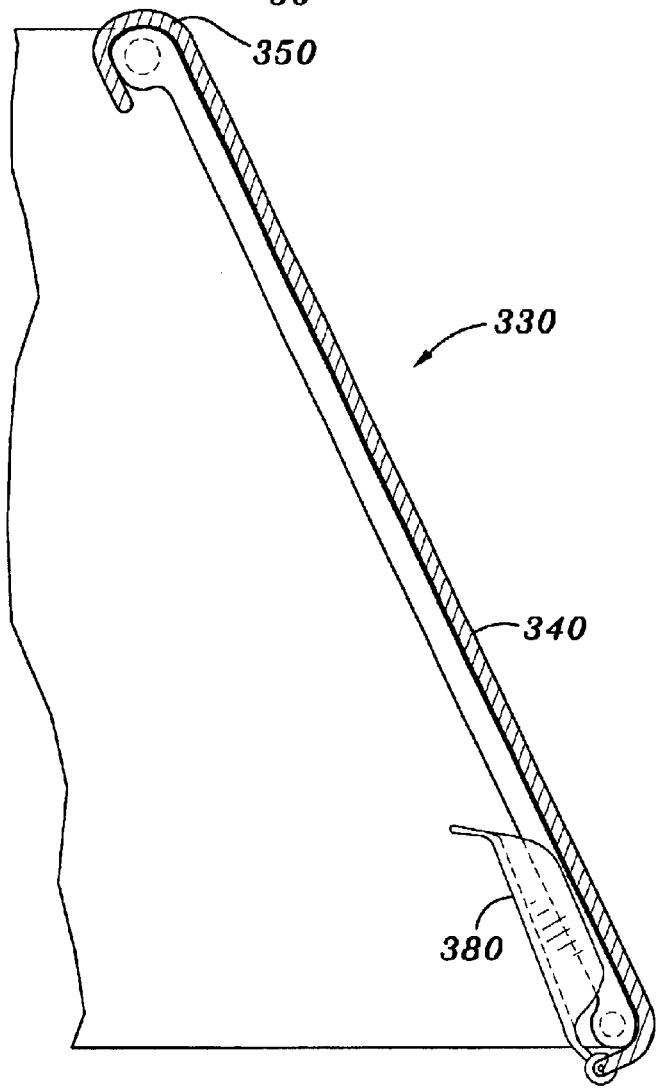
FIG. 4 is an enlarged longitudinal sectional view through two lampshade segments and a segment clip shown in FIG. 1, taken along section line 4—4 therein.
Figure 5:
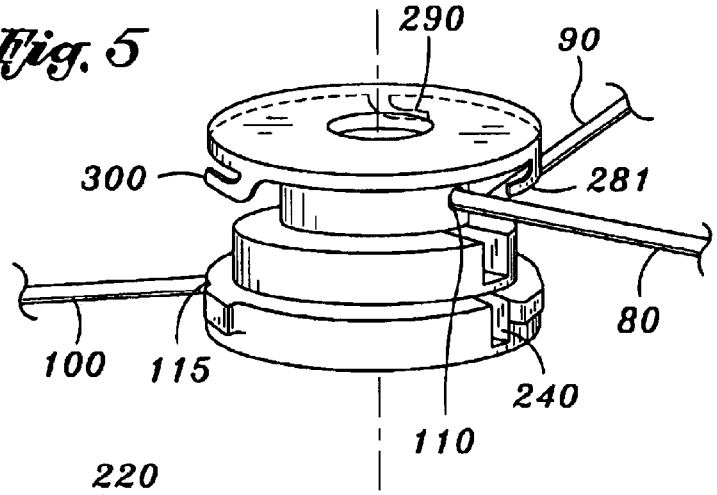
FIG. 5 is an enlarged perspective view of the rotational connector of FIG. 1 in the unlocked telescopically extended configuration.
Figure 6:
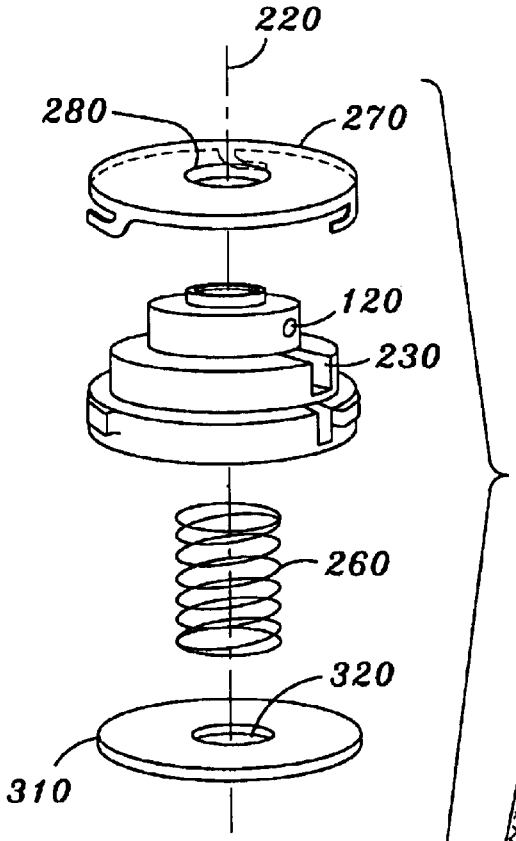
FIG. 6 is an enlarged exploded perspective view of the rotational connector in FIG. 5.
Figure 7:
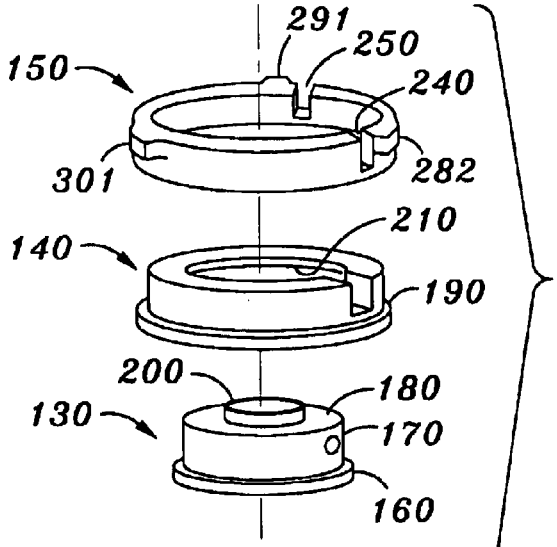
FIG. 7 is an enlarged exploded perspective view of the rotational elements in the rotational connector in FIG. 6.
Figure 8:
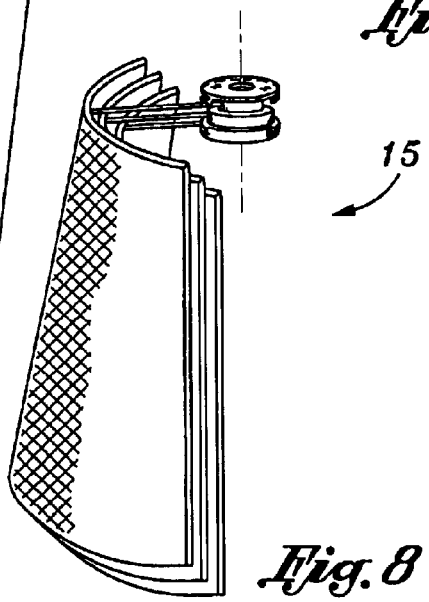
FIG. 8 is a perspective view of a generally conical KD lampshade in its knockdown (KD) state.
Figure 9:
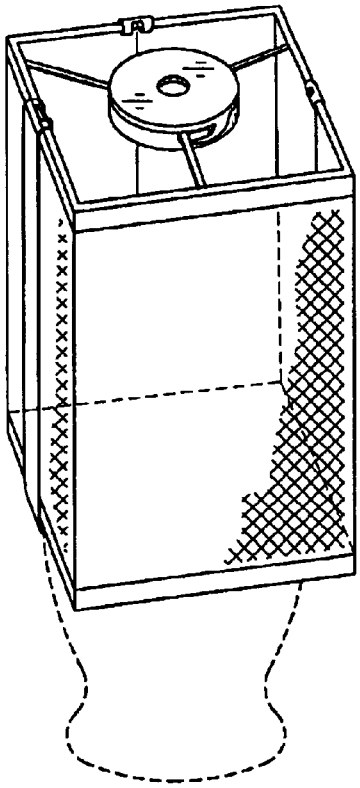
FIG. 9 is a perspective view of a KD lampshade in its assembled state, comprising three generally rectangular lampshade segments connected to rotational connector that is lockingly fitted together in a telescopically compact configuration, the edges of said lampshade being fastened together by three segment clips, in accordance with an embodiment of the present invention.
Figure 10:
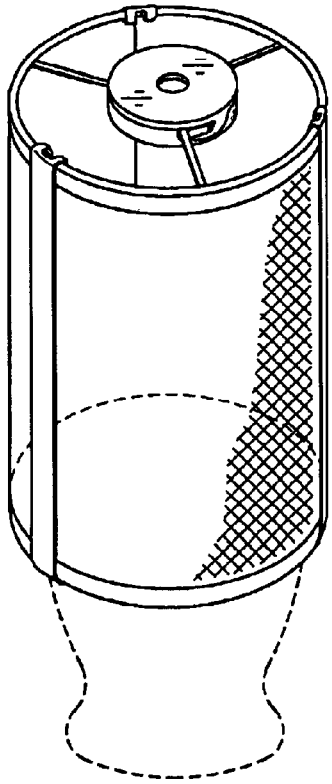
FIG. 10 is a perspective view of a generally cylindrical KD lampshade in its assembled state, comprising three lampshade segments connected to rotational connector that is lockingly fitted together in a telescopically compact configuration, the edges of said lampshade being fastened together by three segment clips, in accordance with an embodiment of the present invention.
Figure 11:
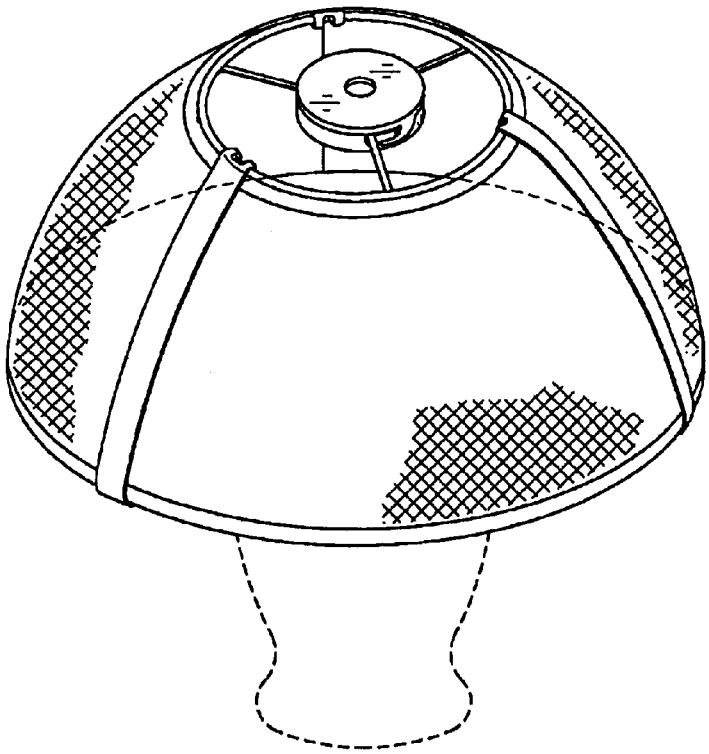
FIG. 11 is a perspective view of a generally hemispherical KD lampshade in its assembled state, comprising three lampshade segments connected to rotational connector that is lockingly fitted together in a telescopically compact configuration, the edges of said lampshade being fastened together by three segment clips, in accordance with an embodiment of the present invention.
Figure 12:
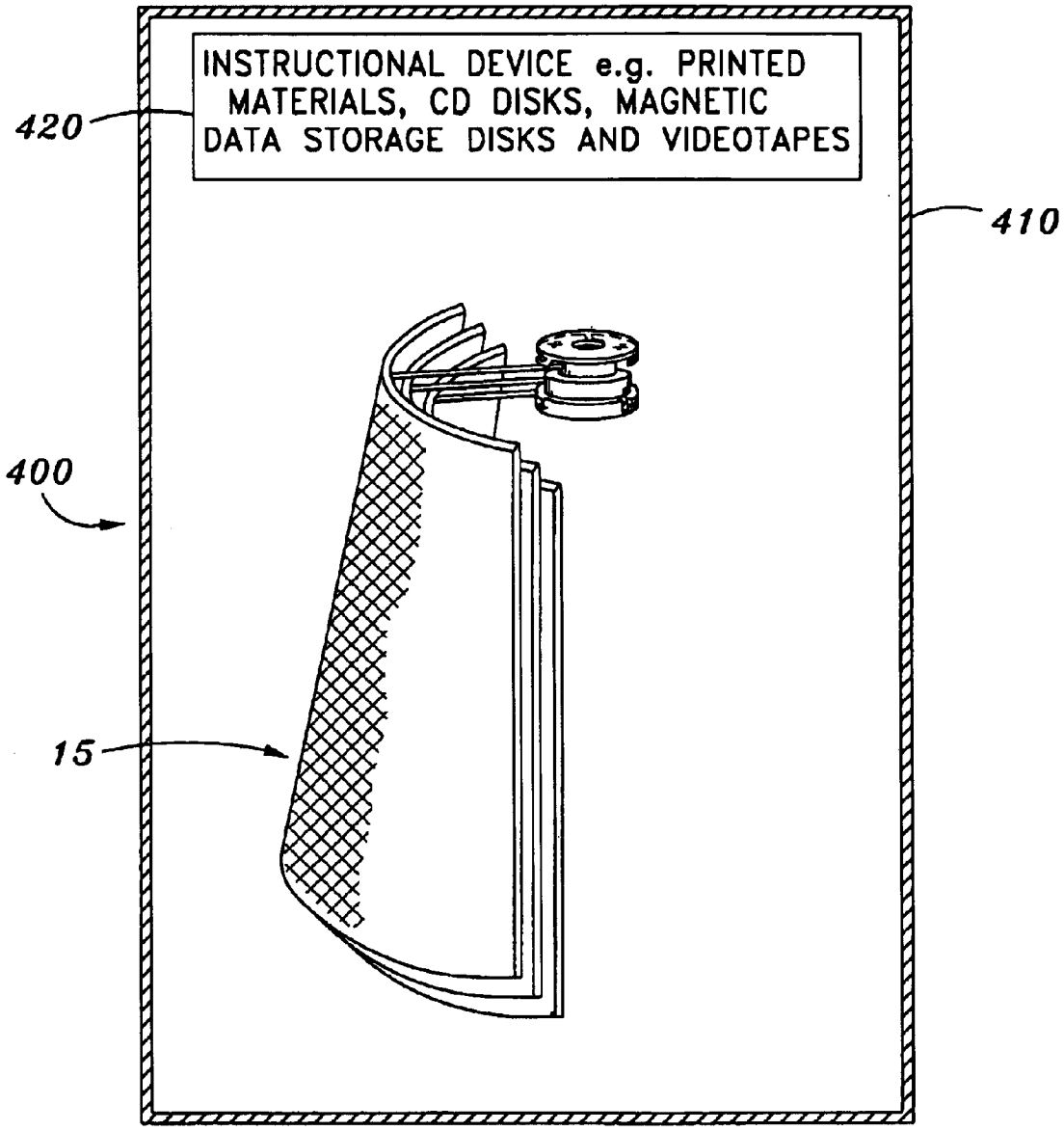
FIG. 12 is a diagrammatic view of a kit for shipping a lampshade adapted for shipping in a knock-down state.

Referring now in more detail to FIGS. 1 through 8, there is shown an embodiment of the invention, comprising in combination a generally conical knockdown lampshade in its assembled configuration, generally indicated at 10. Lampshade 10 comprises a first lampshade segment 20, a second lampshade segment 30 and a third lampshade segment 40. Each segment is of equal size, and comprises 120° of arc of the circumference of lampshade 10. Segment 20 is fixedly secured to a first end 50 of a connecting member 80. Segment 30 is fixedly secured to a first end 60 of a connecting member 90. Segment 40 is fixedly secured to a first end 70 of a connecting member 100. A second end 110 of member 80 is inserted in a hole 120 of a rotational element 130 and fixedly secured therein. A second end (not shown) of member 90 is inserted in a hole (not shown) of a rotational element 140 and fixedly secured therein. A second end (not shown) of member 100 is inserted in a hole 115 of a rotational element 150 and fixedly secured therein.

Element 150 is a hollow cylindrical female member of such size and shape in internal diameter as to be adapted for telescopic penetration by element 140. Element 140 is a hollow cylindrical member of such size and shape in external diameter as to be adapted for telescopic insertion into element 150. Element 140 extends from an abutment surface 190 that comes into abutting contact with element 150 upon insertion. Element 140 is of such size and shape in internal diameter as to be adapted for telescopic penetration by element 130. Element 130 is a hollow cylindrical member of such size and shape in external diameter as to be adapted for telescopic insertion into element 140. Element 130 extends from an abutment surface 190 that comes into abutting contact with an underside 210 of the upper surface of element 140 upon insertion.

A slot 230 centered 120° from the center of the insertion point of member 90 is cut into element 140 above abutment surface 190. Slot 230 is sized to snugly accommodate member 80. A slot 240 centered 120° from the center of the insertion point of member 100 is cut into element 150 for accommodating member 80. Slot 240 is sized to snugly accommodate member 80. A slot 250 centered at 120° from the center of the insertion point of member 100 and 120° from the center of slot 250 is cut into element 150 for accommodating member 90. Slot 250 is sized to snugly accommodate member 90.

A cylindrical linking element 200 is slidingly inserted in an aperture in the top surface of element 130 and fixedly secured to a spring 260. Spring 260 is sized such that it is unable to pass through the aperture in the top surface of element 130. A locking member 270 has an aperture 280 that is fixedly secured to linking element 200. Three hook-like projections 281, 290 and 300 are spaced 120° apart around the periphery of member 270. Element 150 has a rectangular nib 282 projecting radially from its external circumferential surface. Element 150 has a rectangular nib 291 projecting radially from its external circumferential surface. Element 150 has a rectangular nib 301 projecting radially from its external circumferential surface. Projections 281, 290, and 300 are adapted to slidingly engage nibs 282, 291, and 301, respectively, and to cammingly lock them in place. A retaining member 310 has an aperture 320 that is sized to be too small for spring 260 to pass through. Retaining member 310 is fixedly secured to element 150.

In this embodiment of the invention, segments 20, 30, and 40, elements 130, 140, 150, and 200, spring 260, and members 80, 90,100, 270 and 310 form a substantially inseparable assembly generally indicated at 12. In this embodiment of the invention, elements 130, 140, 150, spring 260, and members 270 and 310 include a coextensive passageway 220 as a mounting means for the accommodation of hardware (not shown) for mounting on a lamp.

A segment clip 330 has a body 340 with a first end 350 and a second end 360. End 350 comprises a hook for hooking over the connection between the top of two adjacent lampshade segments, for example 20 and 30. End 360 is pivotally attached to a lever 370 which can be pivotally rotated to a locked position 380 to lock together the borders of two adjacent lampshade segments, for example 20 and 30. Elements 130, 140,150, and member 270 are independently rotatable when projections 281, 290, and 300 are not engaged with nibs 282, 291, and 301, respectively, to be cammingly locked in place, and are thus adapted for rotation to produce a lampshade KD configuration 15 wherein segments 20, 30, and 40 are nested and have minimal shipping volume.

To convert lampshade KD configuration 15 of this embodiment of the invention to the assembled configuration for use as a lampshade, elements 140 and 150 are rotated in a manner to cause slots 230 and 240 to lie in the same plane, and element 130 is rotated to position segment 80 over slot 230. Member 270 and member 310 are urged together in telescopic fashion, for example by pressure such as finger pressure, whereupon segment 80 enters slots 230 and 240, whereas segment 90 enters slot 250. Member 270 is then rotated to urge projections 281, 290, and 300 to slidingly engage nibs 282, 291, and 301, respectively, and to cammingly lock them in place.

A first, a second, and a third clip 330 may decoratively cover the joined borders between segments 20, 30, and 40. A lever 370 of each clip 330 is rotated to a locked position 380 to lockingly secure the clips to afford a clipped assembled lampshade 10. Assembled lampshade 10 may be attached to a lamp by methods known in the lampshade art; for example, by inserting a bolt from the lamp through passageway 220 and securing lampshade 10 with a threaded finial.

A kit 400 for shipping a lampshade structure lampshade adapted for shipping in a knock-down state comprises lampshade 15, packaging materials 410 and at least one device 420 selected from the group consisting of printed materials, CD disks, magnetic data storage disks, and videotapes for explaining the assembly of the lampshade.

On this basis, the instant invention should be recognized as constituting progress in science and the useful arts, as solving the problems in knockdown designs for lampshades enumerated above. In the foregoing description, certain terms have been used for brevity, clearness and understanding, but no unnecessary limitations are to be implied therefrom beyond the requirements of the prior art, because such words are used for descriptive purposes herein and are intended to be broadly construed.

Having described preferred embodiments of the invention with reference to the accompanying drawings, it is to be understood that the invention is not limited to those precise embodiments, and that the various changes and modifications may be effected therein by one skilled in the art without departing from the scope or spirit of the invention as defined in the appended claims. For example, the lampshade can have many other shapes, and can make use of many different lampshade construction materials. As a further example, the invention can be used for a lampshade that is divided into numerous segments, preferably about 2–6 segments, and even more preferably about 3–4 segments. Thus, the scope of the invention should be determined by the appended claims and their legal equivalents, rather than by the examples given.

What is claimed is:

1. A lampshade adapted to be interconvertible between an assembled configuration having a first volume and a knock-down configuration having a second, smaller volume; said lampshade comprising in combination:

at least two lampshade segments;

a predetermined number of connecting members;

a predetermined number of rotational elements;

said rotational elements adapted to be positioned within one another;

said rotational elements having a common axis of rotation;

said connecting members adapted for connecting a preselected said rotational element with a preselected said lampshade segment;

assembly means adapted to permit rotational movement of at least said rotational elements and to maintain at least said rotational elements in a substantially inseparable assembly;

slotting means on preselected said rotational elements adapted to slottingly fit said connecting members;

said slotting means further adapted to position said connecting members to assume predetermined angular positions with respect to said common axis; and, locking means adapted for lockingly positioning said connecting members in said predetermined angular positions.

2. The lampshade according to claim 1, wherein said assembly means comprise spring means.

3. The lampshade according to claim 2, wherein said spring means are disposed on said common axis and adapted to urge said rotational elements and said locking means apart on said common axis; said spring means further adapted to permit rotational movement of said locking means and said rotational elements; and, said spring means further adapted to maintain said rotational elements and said locking means in a substantially inseparable assembly.

4. The lampshade according to claim 1, further comprising mounting means for mounting said lampshade on a lamp.

5. The lampshade according to claim 1, wherein said connecting members are attached to said preselected rotational elements and said preselected lampshade segments by attachment means.

6. The lampshade according to claim 5, wherein said attachment means is selected from the group consisting of welding, soldering, gluing, press fitting, tying, wiring, bolting, crimping, and manufacture as a single unit.

7. The lampshade according to claim 1, further comprising clipping means adapted for dipping together preselected borders of said lampshade segments.

8. The lampshade according to claim 1, wherein said segments are segments of a generally conical shape.

9. The lampshade according to claim 1, wherein said segments are segments of a generally cylindrical shape.

10. The lampshade according to claim 1, wherein said segments are segments of a generally hemispherical shape.

11. The lampshade according to claim 1, wherein said segments have a generally rectangular shape.

12. A generally conical lampshade adapted to be interconvertible between an assembled configuration having a first volume and a knock-down configuration having a second, smaller volume; said lampshade comprising in combination:

three lampshade segments;

three connecting members;

three rotational elements;

said rotational elements adapted to fit telescopically into each other;

said rotational elements having a common axis of rotation;

each connecting member having a first end and a second end;

each said first end adapted for attachment by attachment means to a preselected lampshade segment;

each said second end adapted for attachment by attachment means to a preselected said rotational element;

slotting means on preselected rotational elements adapted to allow said connecting members to lie in a single plane;

said slotting means further adapted to position said connecting members to assume predetermined angular positions with respect to said common axis;

locking means disposed on said common axis adapted for arresting movement of said rotational elements when said connecting members lie in said single plane and in said predetermined angular position;

a spring adapted to urge said rotational elements and said locking means apart on said common axis of rotation; said spring means further adapted to permit rotational movement of said locking means and said rotational elements; and, said spring means further adapted to maintain said rotational elements and said locking means in a substantially inseparable assembly;

three clips adapted for connecting preselected borders of said lampshade segments; and, means for mounting said lampshade on a lamp.

13. A method for knock-down shipping and subsequent reassembly of a lampshade adapted to be interconvertible between an assembled configuration having a first volume and a knock-down configuration having a second, smaller volume; said lampshade comprising in combination:

at least two lampshade segments;

a predetermined number of connecting members;

a predetermined number of rotational elements;

said rotational elements adapted to be positioned within one another;

said rotational elements having a common axis of rotation;

assembly means adapted to permit rotational movement of at least said rotational elements and to maintain at least said rotational elements in a substantially inseparable assembly;

said connecting members adapted for connecting a preselected rotational element with a preselected lampshade segment;

slotting means on said rotational elements adapted to slottingly fit said connecting members;

said slotting means further adapted to position said connecting members to assume predetermined angular positions with respect to said common axis; and, locking means adapted for lockingly positioning said connecting members in said predetermined angular positions;

said method comprising the steps of:

(a) providing said lampshade in said assembled configuration having a first volume;

(b) unlocking said locking means;

(c) urging said rotational elements and said locking means apart on said common axis of rotation;

(d) positioning said segments into said knock-down configuration having a second, smaller volume;

(e) packaging said lampshade in said knock-down configuration in a package;

(f) transporting said package as a shipment;

(g) unpacking said shipment;

(h) rotating said segments into said assembled configuration;

(i) urging said rotational elements and said locking means together on said common axis of rotation; and, j) locking said locking means.

14. The method according to claim 13, wherein said assembly means comprise spring means.

15. The method according to claim 13, wherein said lampshade further comprises clipping means adapted for clipping together preselected borders of said lampshade segments, and wherein step (a) of said method further comprises unclipping said clipping means, and wherein step (j) further comprises clipping together preselected borders of said lampshade segments.

16. A kit for shipping a lampshade adapted for shipping in a knock-down state, said kit comprising:

(a) the lampshade of claim 1;

(b) packaging materials; and, (c) at least one device for explaining the assembly of said lampshade.

17. A kit according to claim 16, wherein said instructional device is at least one device selected from the group consisting of printed materials, CD disks, magnetic data storage disks, and videotapes.

18. A kit for shipping a lampshade adapted for shipping in a knock-down state, said kit comprising:

(a) the lampshade of claim 12;

(b) packaging materials; and, (c) at least one instructional device for explaining the assembly of said lampshade.

19. A kit according to claim 18, wherein said instructional device is at least one device selected from the group consisting of printed materials, CD disks, magnetic data storage disks, and videotapes.

* * * * *